US010967889B2

(12) United States Patent
Schäfer

(10) Patent No.: US 10,967,889 B2
(45) Date of Patent: Apr. 6, 2021

(54) RAIL SYSTEM FOR SINGLING OUT AND REROUTING RAIL VEHICLES

(71) Applicant: SCHÄFER ZECHLIN GBR, Hennigsdorf (DE)

(72) Inventor: Tristan Schäfer, Hennigsdorf (DE)

(73) Assignee: SCHÄFER ZECHLIN GBR, Hennigsdorf (DE)

( * ) Notice: Subject to any disclaimer, the term of this patent is extended or adjusted under 35 U.S.C. 154(b) by 167 days.

(21) Appl. No.: 15/756,204

(22) PCT Filed: Aug. 26, 2016

(86) PCT No.: PCT/EP2016/070218
§ 371 (c)(1),
(2) Date: Feb. 28, 2018

(87) PCT Pub. No.: WO2017/036975
PCT Pub. Date: Mar. 9, 2017

(65) Prior Publication Data

US 2018/0237038 A1 Aug. 23, 2018

(30) Foreign Application Priority Data

Aug. 28, 2015 (DE) ..... 10 2015 114 335.6

(51) Int. Cl.
*B61G 7/00* (2006.01)
*B61L 5/02* (2006.01)
(Continued)

(52) U.S. Cl.
CPC *B61L 5/02* (2013.01); *B61L 5/10* (2013.01); *B61L 11/02* (2013.01); *B61L 7/02* (2013.01)

(58) Field of Classification Search
CPC ... B61G 7/00; B61G 7/06; B61G 7/08; B61G 7/10; B61G 7/12
See application file for complete search history.

(56) References Cited

U.S. PATENT DOCUMENTS 905,656 A 12/1908 Cook
1,355,262 A 10/1920 Quintal
(Continued)

FOREIGN PATENT DOCUMENTS

DE 181 231 A 2/1907
DE 11 31 711 B 6/1962
(Continued)

OTHER PUBLICATIONS

International Search Report dated Nov. 16, 2016, dated Jan. 17, 2017.
(Continued)

*Primary Examiner* — Robert J McCarry, Jr.
(74) *Attorney, Agent, or Firm* — Norris McLaughlin, P.A.

(57) ABSTRACT

The invention relates to a point machine for a rail switch, comprising at least one switching mechanism, designed to transmit at least one switching force onto at least one switch point and at least one switching element, designed to transmit at least one switching force onto the switching mechanism. According to the invention, the at least one switching element is designed to convert a load which is moved by the switching element substantially in a longitudinal direction (L) relative to the switching element to a torque. The invention also relates to a switch point, a point device having said switch point, a rail switch comprising said point device, and a center buffer coupling and to a rail vehicle having said center buffer coupling and to a rail traffic system comprising the rail vehicle and the rail switch.

6 Claims, 9 Drawing Sheets

Figure 2:
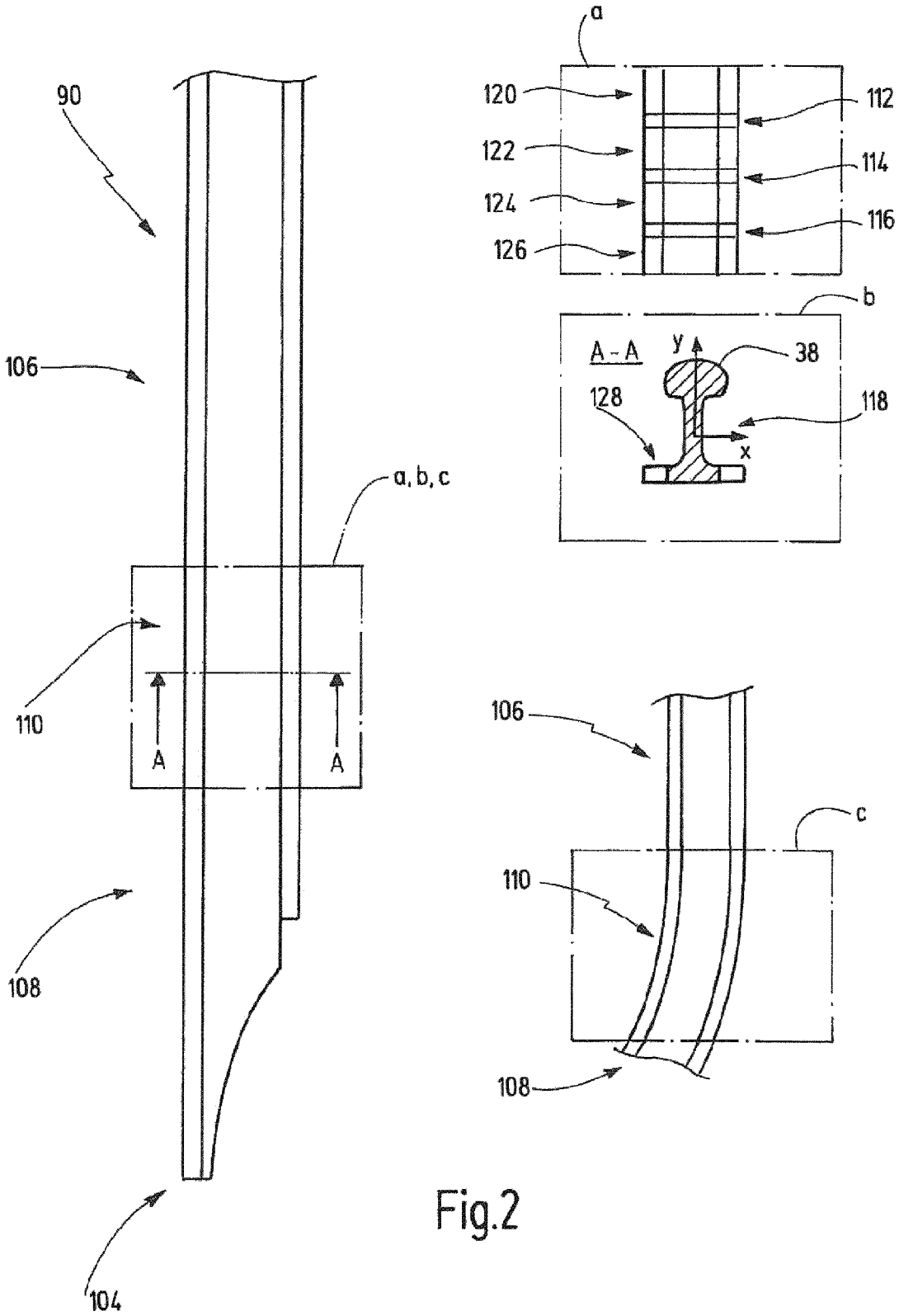

(51) Int. Cl.

| | |
|---|---|
| ***B61L 11/02*** | (2006.01) |
| ***B61L 5/10*** | (2006.01) |
| *B61L 7/02* | (2006.01) |

(56) References Cited

U.S. PATENT DOCUMENTS

| | | | | |
|---|---|---|---|---|
| 8,091,717 | B2 * | 1/2012 | Sprave ..... | B61G 7/12<br>213/20 |
| 2008/0264891 | A1 | 10/2008 | Sprave et al. | |

FOREIGN PATENT DOCUMENTS

| | | | |
|---|---|---|---|
| DE | 22 35 014 | A | 1/1974 |
| DE | 196 37 546 | A1 | 3/1998 |
| FR | 373 836 | A | 5/1907 |
| WO | 2008/132124 | A1 | 11/2008 |

OTHER PUBLICATIONS

English Translation of International Search Report dated Nov. 16, 2016, dated Jan. 17, 2017.

* cited by examiner

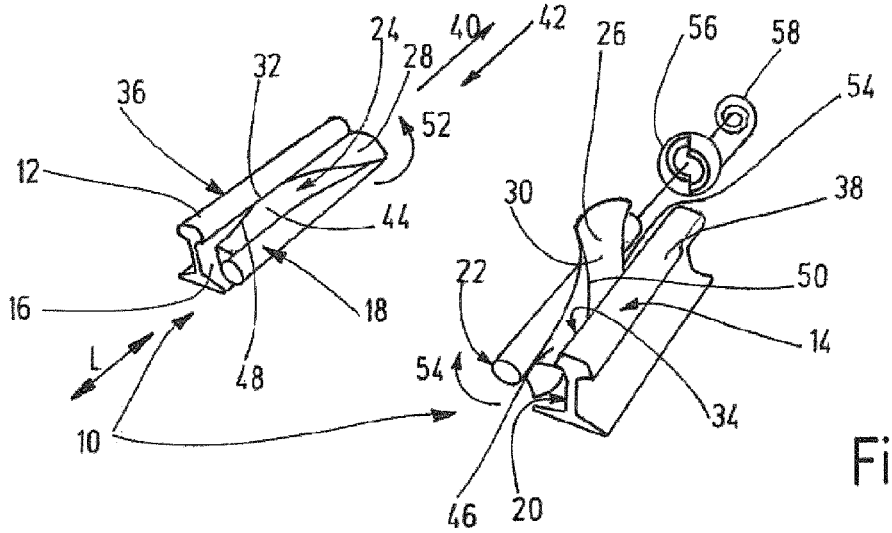
Fig.1
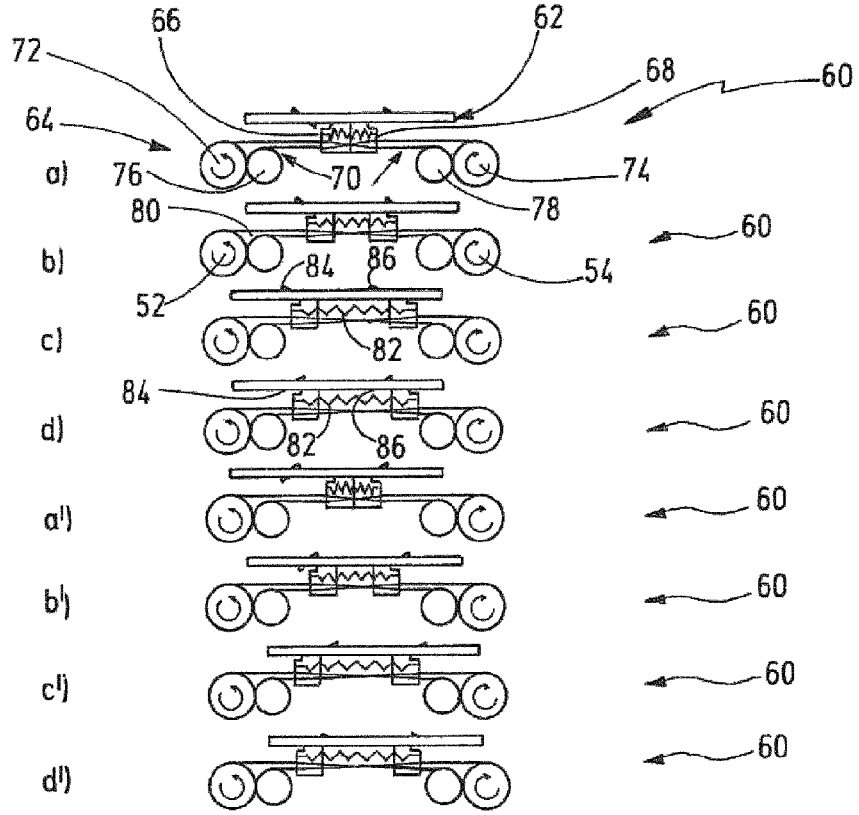
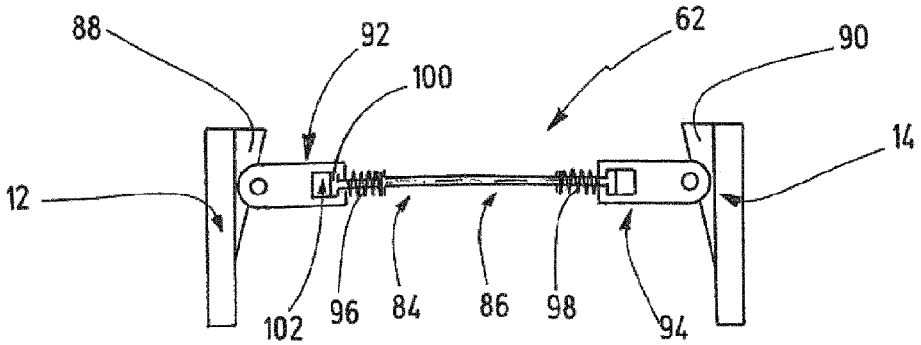

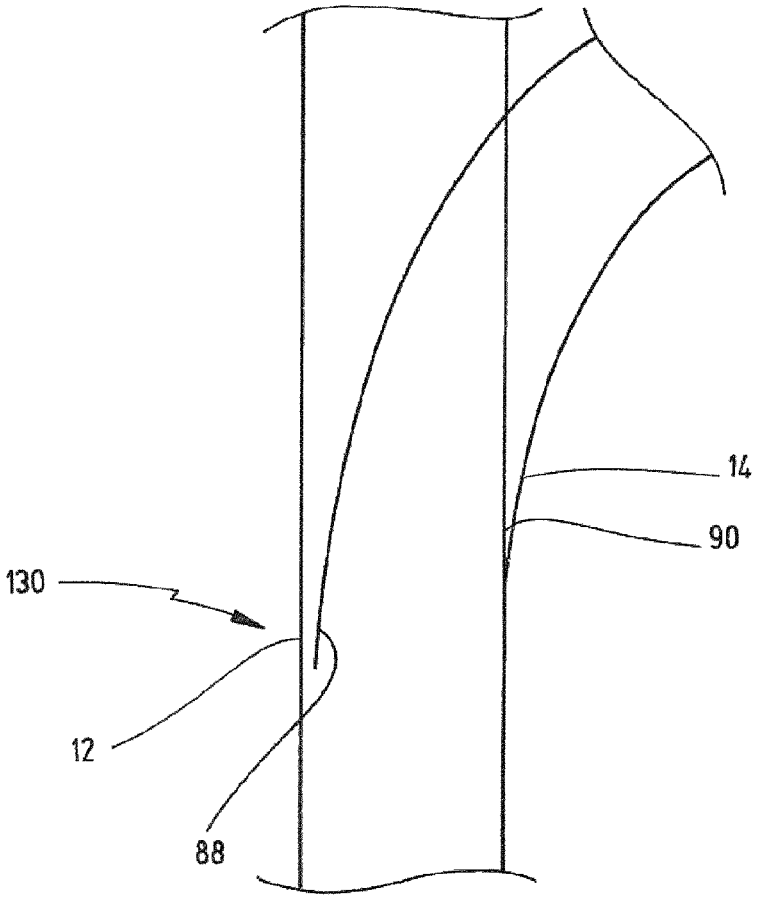
Fig.3
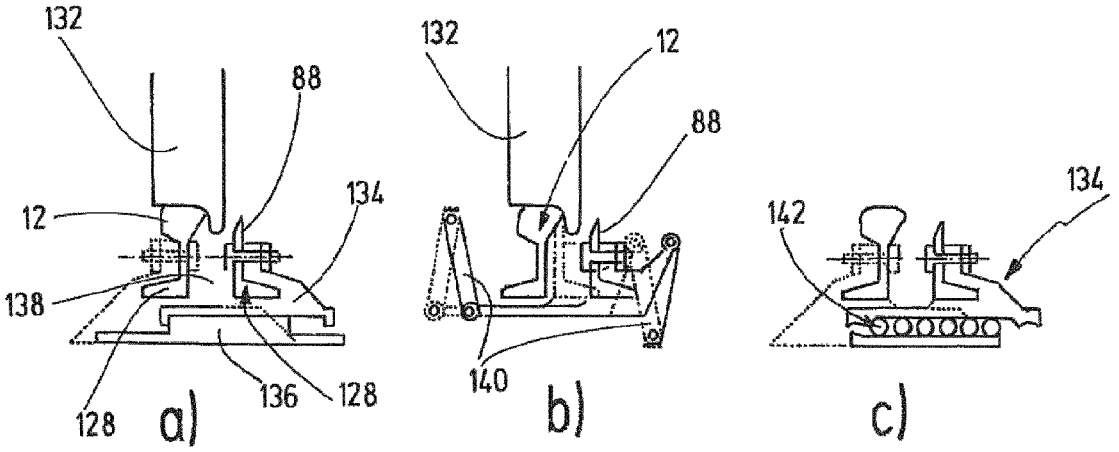

RAIL SYSTEM FOR SINGLING OUT AND REROUTING RAIL VEHICLES

This application is the U.S. National Stage of International Application No. PCT/EP2016/070218, filed Aug. 26, 2016, which claims foreign priority benefit under 35 U.S.C. § 119 of German Application No. 10 2015 114 335.6 filed Aug. 28, 2015.

The invention relates to a point machine for a railroad switch, a point blade for a railroad switch, and a railroad switch with the point machine and the point blade and a central buffer coupler and a railroad vehicle with the central buffer coupler and a rail traffic system with the railroad switch and the rail vehicle.

It is known to connect individual rail cars to form trains and to separate them again. In this conventional rail classification yard operation, the individual rail vehicles of a train are successively disconnected and pushed over a so-called hump. Due to gravity, the separated rail vehicles speed up on the inclined plane of the hump and are sorted into the individual tracks of the so-called classification bowl by a set of switches, and then are assembled there into new trains. [0003]

Such an approach is disadvantageous in terms of time loss and land use. First, the regular running of the train must be interrupted as soon as individual rail cars of the train are to be routed in different directions. Also, the corresponding shunting devices require a high use of resources such as land and capital.

It is therefore an object of the present invention to provide a rail system to allow a train to be separated into individual vehicles and route these into different directions without stopping the train, with little effort.

The task is solved by the subject matter set forth herein.

The invention relates to a point machine for a rail switch, comprising at least one actuating mechanism which is designed to transmit at least one force to at least one point blade, and at least one drive element which is formed in a way to be able to transmit at least one actuating force to the actuating mechanism. According to the invention, the at least one drive element is formed in a way to convert a load moving in an essentially longitudinal direction relatively to the drive element into a torque.

This offers the advantage that the point machine itself can be operated by the rail vehicle travelling across it. Advantageously, the torque is available as a mechanical input for generating an actuating force. The point machine is thus particularly simple, fast, reliable, flexible and efficient.

In a preferred embodiment of the invention provides that the drive element is made to be able to convert loads that are substantially moved in opposite directions relative to the drive element into substantially opposite torques.

This offers the advantage that the point machine can be driven on in two directions. Driving from a first direction can be made to generate an actuating force on the drive element which is transmitted to the operating mechanism. Driving from a second direction which is substantially opposite to the first direction is possible, wherein the drive element is formed to evade a wheel of the rail vehicle through an opposite rotational movement. Thus, the safety of the point machine is advantageously increased.

In another preferred embodiment of the invention it is envisaged that the at least one drive element has a helix-like structure in at least on one portion.

This offers the advantage that the conversion of the torque is particularly easy and secure. In an especially advantageous embodiment of the invention, the at least one drive element is placed parallel to a stock rail. By means of the helical structure, the load of a wheel flange of a rail vehicle can be converted particularly well into a torque. Furthermore, a helical structure provides a very flexible customizable embodiment of the drive element, and can be arranged in a compact way. A helical structure is particularly suitable for operation by a load that is moved over the helical structure.

In another preferred embodiment of the invention it is provided that the at least one point drive mechanism comprises means for transmitting the at least one torque from the at least one drive element into a positioning force on the at least one point blade.

This offers the advantage that a positioning force is particularly easy to be produced. Furthermore, the positioning force can be adapted particularly well by appropriate design of the drive element.

In another preferred embodiment of the invention provides that the means comprise at least one follower element operatively connected to the at least one drive element. A force can thus be transmitted to the actuating mechanism in a particularly simple and efficient manner.

In another preferred embodiment of the invention it is provided that the means comprise at least one control mechanism, which can be operatively connected via the at least one follower element to the at least one drive element on the input side and the at least one point blade on the output side.

This offers the advantage that a quick change of direction of the positioning force is possible. Setting of the point machine in various operating modes can be advantageously easy and fast.

In another preferred embodiment of the invention it is provided that the control mechanism comprises a rotatable setting element with at least two tilting latches. The tilting latches can for example serve as end stops for the follower elements.

This offers the advantage that the number of moving parts required to switch the point machine is reduced and the switching process becomes easier and safer.

Another aspect of the present invention relates to a point blade for a railroad switch. According to the invention it is provided that partial sections of the point blade can move to form independently different track courses.

This offers the advantage that the point blade can be switched while being driven on. For example, the point blade can be switched after a wheelset of a rail vehicle has passed. Via its wheels, the rail vehicle can hold the portion of the point blade in the position it was in before switching, while the point blade can already be switched to another position in the portion near the point machine.

The operating states are in particular defined by the position of the point blade in a certain section which can be assigned to a particular track course.

In a preferred embodiment of the invention it is provided that the point blade has at least a partial area with increased elasticity, which is arranged between at least two partial sections with a lower elasticity.

This offers the advantage that the part region of enhanced elasticity makes it possible that the two partial sections of lower elasticity can orient relative to one another flexible. The sub-regions can be tailored to your specific requirements accordingly particularly easy on each other.

In another preferred embodiment of the invention it is provided that the point blade has a cross-sectional profile over its length, wherein a ratio of an area moment of inertia about a transverse axis in relation to a moment of inertia about a vertical axis in the region of a tip of the blade is up to 41 and in the direction of a first rail fastening drops to a value of up to 6. The latter corresponds to a conventional rail. The vertical axis and the transverse axis respectively correspond to a cross-sectional profile of a conventional full track. The location of the axes is exemplified in FIG. 2. The exact variation of the values of this ratio between the tip of the blade and the first rail fastening, at which no movement of the rail is possible, is selected by an appropriately skilled person according to general railroad engineering criteria and in particular in accordance with the track course to be realized, and according to the resulting bend lines of the point blade as well according to the loads applied by rail vehicles. Thus values of over 41 as maximum values can also result.

This provides the advantage that the point blade can be designed in a way to be very robust in places bearing high load while still being easily flexible in places requiring high elasticity.

Another aspect of the present invention relates to a set of point blades, comprising at least one point blade according to the invention for a rail switch and at least one stock rail.

This offers the advantage that it is simultaneously possible to direct two consecutive wheels of a rail vehicle moving on the stock rail, in two different directions, wherein one of the rail vehicles can still be on the point blade.

In a preferred embodiment of the invention it is provided that the switch device comprises at least one sliding element allowing to guide and/or support the at least one point blade and the loads applied to the at least one point blade.

This offers the advantage that the point blade can be moved particularly easily under load.

In another preferred embodiment of the invention it is provided that a mounting portion of the point blade and/or the stock rail is at least partially removed. The fastening portion may for example be a foot of a rail.

This offers the advantage that a gap is increased between the point blade and the stock rail. This reduces the risk of a blockage of the point blade by for example foreign bodies.

Another aspect of the present invention relates to a rail switch, comprising at least one point machine according to the invention for a rail switch and/or at least one set of point blades of the invention.

This offers the advantage that the point machine can be switched by the rail vehicle itself. Thus, several directly successive rail vehicles can be advantageously directed in different directions. Since the rail vehicles themselves operate the point machine via their wheels and the driving elements of the point machine, it can be ensured that the point machine is fully actuated before the rail vehicle reaches the tip of the blade. Due to the possibility of the point blades forming different track courses, the point machine can be actuated even if there is still a preceding rail vehicle on the point blade. The rail switch can thus be switched in a particularly quick, safe and easy manner, even if a wheelset of a preceding rail vehicle is still located on the point blade behind the tip of the blade and a wheelset of a subsequent rail vehicle is on the stock rail before the tip of the blade.

Another aspect of the present invention relates to a central buffer coupler for a rail vehicle, comprising at least one coupler arm which can be mounted to the rail vehicle in at least one degree of freedom and comprising at least one coupling mechanism further comprising at least one locking mechanism which is designed to lock and unlock the coupling mechanism. According to the invention it is provided that at least one end stop is arranged within the pivoting range, in order to actuate and open the locking mechanism.

This offers the advantage that the locking mechanism can be automatically actuated and opened by generating a horizontal track offset between two rail vehicles coupled via the central buffer coupler.

In a preferred embodiment of the invention it is provided that the coupling mechanism is movably mounted to the coupler arm in at least one degree of freedom.

This offers the advantage that a possible track offset is increased. This provides more time for the process of unlocking and disengagement of the coupling mechanisms of two mutually to-be uncoupled central buffer couplers. Thus undercuts of the geometries of the central buffer couplers, which could hinder a sliding disengagement, are advantageously avoided. The safety of the central buffer coupler is thereby increased.

In another preferred embodiment of the invention it is provided that the locking mechanism is adapted to lock and release the at least one degree of freedom between the coupling mechanism and the coupler arm.

This offers the advantage that the central buffer coupler can be secured in a non-coupled state. Also advantageous is the fact that a relative deflection of two intercoupled central buffer couplers is thus not possible, so the entire link is always in a straight state and the transmission of forces is particularly safe.

In another preferred embodiment of the invention provides that the central buffer coupler comprises means which are adapted to return the coupler arm and/or the coupling mechanism to an initial position after a deflection.

This offers the advantage that after separation the central buffer coupler is automatically moved back into a safe and ready-to-couple state.

Another aspect of the present invention relates to a rail vehicle, comprising at least one central buffer coupler according to the invention for a rail vehicle.

This offers the advantage that while rolling the rail vehicle is automatically uncoupled from another rail vehicle when a vertical track offset is applied between the rail vehicles.

Another aspect of the present invention relates to a rail transport system comprising at least one rail vehicle according to the present invention and at least one rail switch according to the present invention. Preferably at least two rail vehicles according to the invention are provided.

This offers the advantage that the rail vehicles can be directed in different directions while still being coupled and the vehicles can be uncoupled from each other automatically due to the resulting track offset. The rail system thus is highly flexible and efficient. In addition, the rail system is very safe and easy, since most procedures can be done in a purely mechanical way. The rail system is also particularly safe because the rail vehicles themselves operate on the drive elements, actuate the point machine and then travel the point blades thus keeping them in position for themselves while the blade tips are re-adjustable for a subsequent rail vehicle.

The present invention relates to all types of rail systems known to a person having ordinary skill in the art, especially to monorail and multi-rail systems as well as all known types of rails themselves.

Further preferred embodiments of the invention emerge from the other characteristics, referred to in the subclaims.

The various embodiments of the invention mentioned in this application are, unless otherwise noted in the individual case, advantageously combinable.

DETAILED DESCRIPTION

Figure 4:
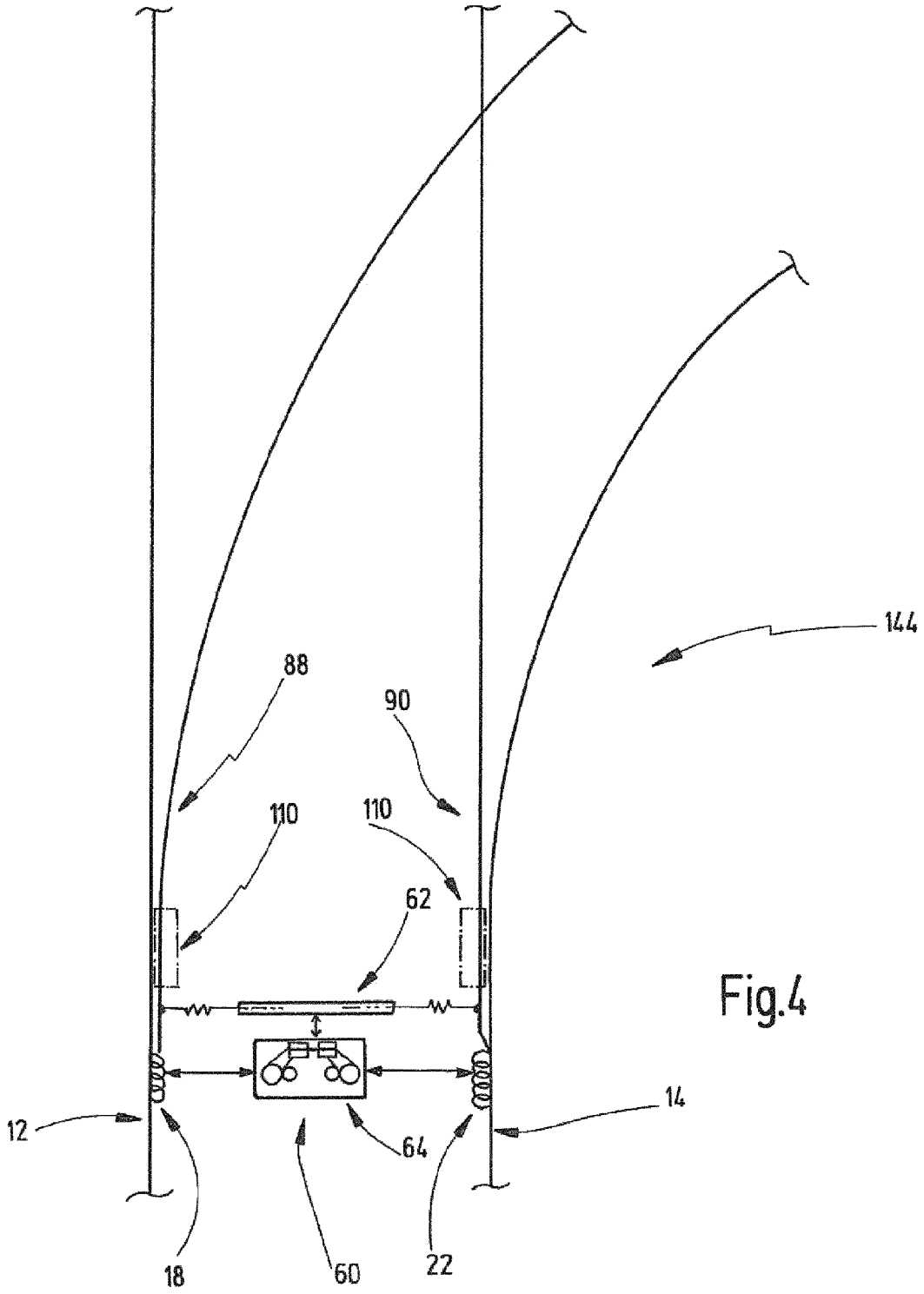
Figure 5:
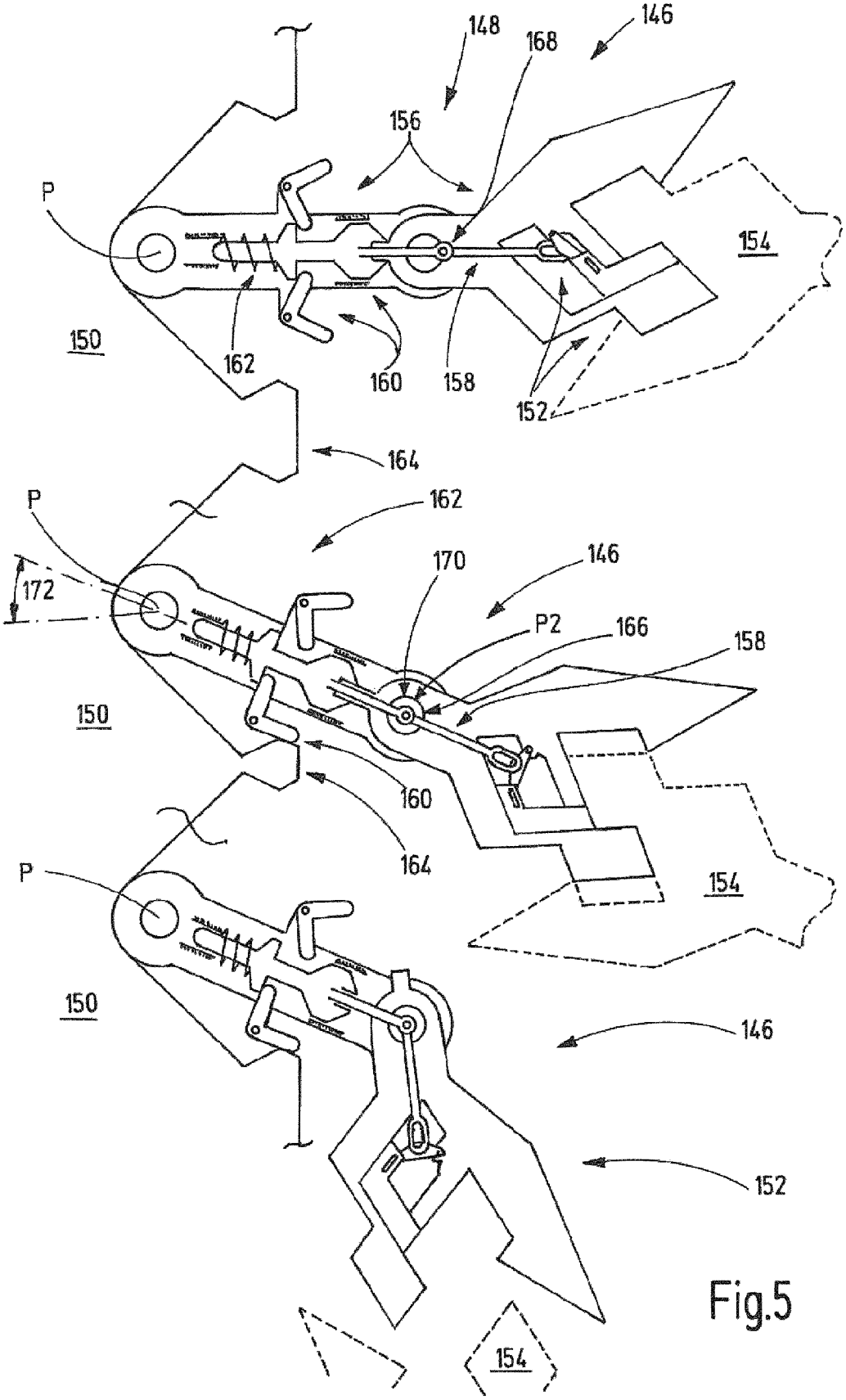
Figure 6:
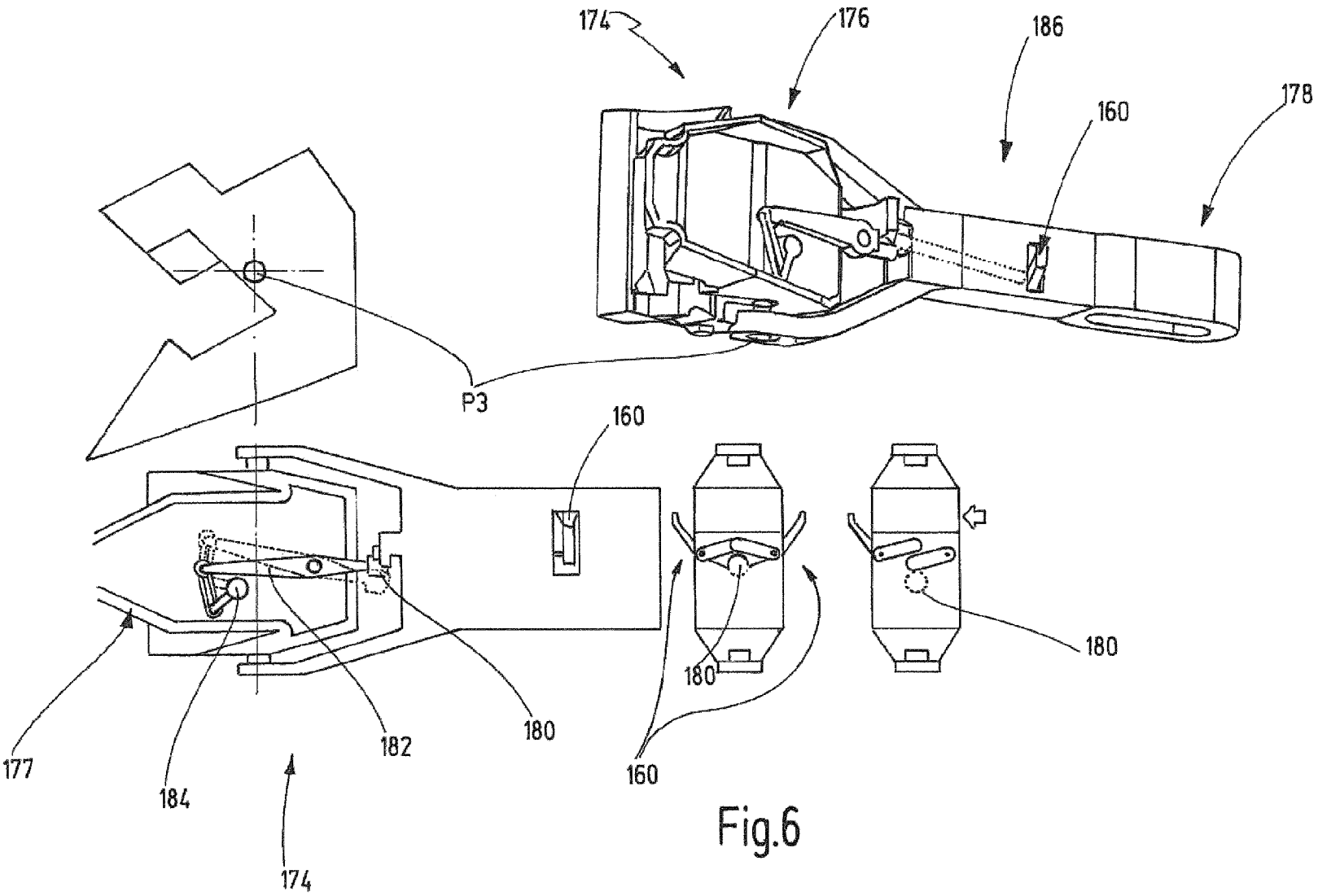
Figure 7:
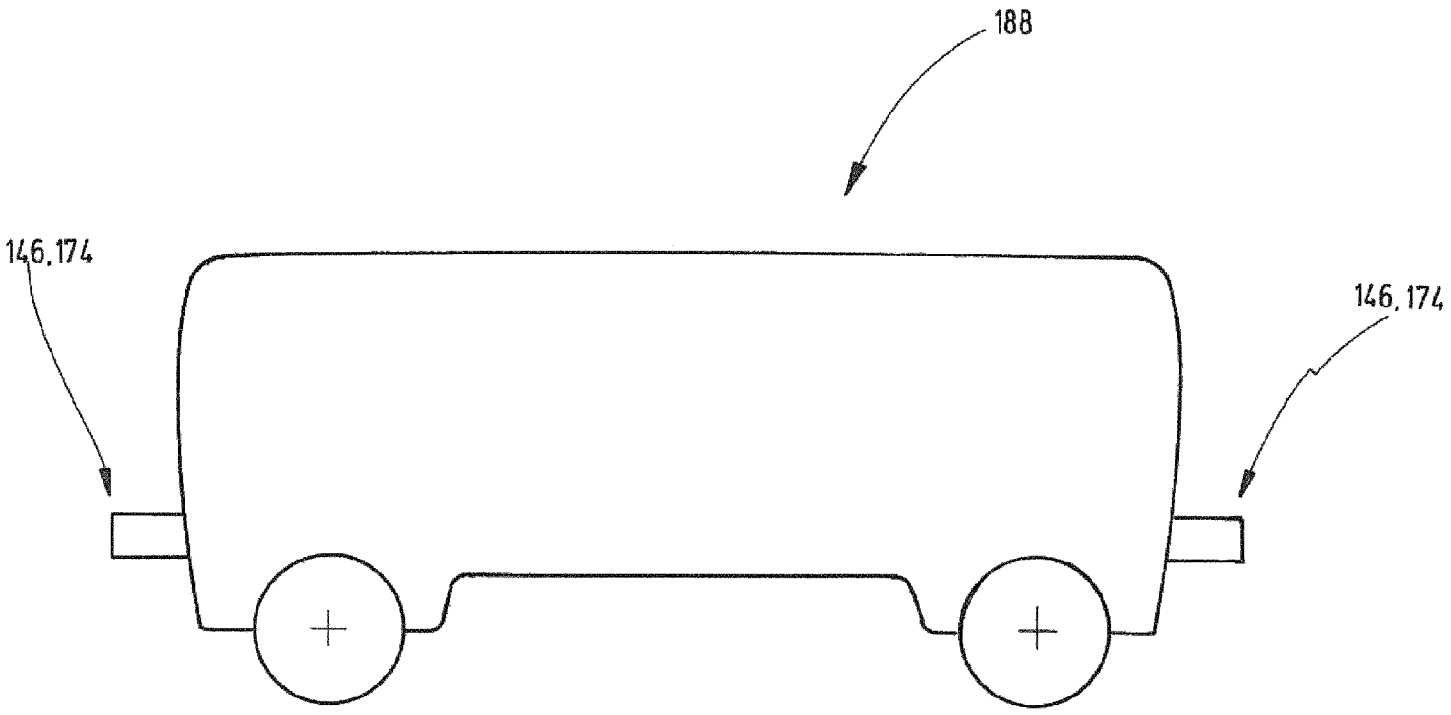

The invention is explained below with reference to an embodiment and accompanying drawings. The figures show:

FIG. 1: A schematic representation of a point machine according to the invention for a rail switch in a preferred embodiment;

FIG. 2: A schematic representation of a point blade according to the invention for a rail switch in a preferred embodiment;

FIG. 3: A schematic view of a blade device of the invention in a preferred embodiment;

FIG. 4: A schematic representation of a railroad switch according to the invention in a preferred embodiment;

FIG. 5: A schematic representation of a central buffer coupler for a rail vehicle according to the invention in a preferred embodiment;

FIG. 6: A schematic representation of a central buffer coupler for a rail vehicle according to the invention in a further preferred embodiment;

FIG. 7: A schematic representation of a rail vehicle according to the invention in a preferred embodiment; and FIGS. 8*a*)-8*d*): Schematic representations of a rail transport system according to the invention in a preferred embodiment.

FIG. 1 shows a schematic representation of a point machine according to the invention for a rail switch in a preferred embodiment.

The upper part of 1 schematically shows a pair of rails 10. The pair of rails 10 comprises a first stock rail 12 and a second stock rail 14. On an inner side of the first stock rail 16 a drive element 18 is arranged. On an inner side of the second stock rail 20 is also a drive element 22 arranged. The drive elements 18, 22 are rotatably mounted relative to their respective stock rails 12, 14. The longitudinal axis extends essentially parallel to the longitudinal axes of the first and second stock rail, in this arrangement 12,14. The drive elements 18, 22 feature partially helical structures 24, 26. The drive elements 18, 22 are rotatably arranged in such a way beside the first and second stock rails 12, 14 so the outer surfaces 28, 30 of the helical structures 24, 26 do not contact the inner surfaces 32, 34 of the rail heads 36, 38 or arranged in such a way to be arranged offset and lower than these. The arrangement is made with the aim that travel along the stock rails 12, 14 is possible with a rail vehicle without interference, while a wheel flange of the railroad vehicle can transmit a force on the helical structures 24, 26. In other embodiments, a rolling of the helical structures 24. 26 on the stock rails 12, 14 is possible. The upper part of 1 shows a position of the drive elements 18, 22 in a non-extended state.

The drive elements 18, 22 can now be activated in two ways. A rail vehicle can travel along the pair of rails 10 in a first direction 40 or a second direction 42. When the vehicle is traveling along the pair of rails 10 in the first direction 40, the wheels of the rail vehicle can be thought of as point loads moving along the stock rails 12,14 in the first direction 40. In doing so, the flanges of the wheels of the rail vehicle move essentially along the inner surfaces 32, 34 the rail heads 36, 38.

If the rail vehicle approaches in the first direction 40, the wheel flanges push on the inner surfaces of the helical structures 24, 26. In doing so, the wheel flanges can also push on the respective first edges 48, 50 of the helical structures 24, 26.

The flanges thus apply a moving load to the inner surfaces 44, 46 and/or the first edges 48, 50 of the helical structures 24, 26, the direction of this moving load being substantially longitudinal, corresponding to the direction of movement 40, and moving relative to and across the drive elements 18, 22. On the basis of the spatial curvature of the inner surfaces 44, 46 and/or the first edge 48, 50, this force causes a rotational movement 52, 54 of each the drive elements 18, 22. Thereby, each produces a corresponding torque. The design and arrangement of the drive elements 18, 22 is carried out with the aim of the first edge 48, 50 and the inner surfaces 44, 46 being at least sectionally arrangeable in a gap formed by the wheel flanges and the inner surfaces 32, 34 of the rail heads 36, 38.

In other words, the drive elements 18, 22 are displacable by the wheels of the rail vehicle moving along the pair of rails 10 in a way that produces a torque in the drive elements 18, 22.

If the the rail vehicle travels along the pair of rails 10 in the second direction 42, the torque is applied in an analogous manner. The flanges of the rail vehicle then push on a second edge or adjacent thereto further inner surfaces of the helical structures 24, 26. The drive elements 18, 22 then each rotate in the opposite direction as the rotational movements 52, 54. Accordingly, the resulting torques are now opposite to those torques which can be generated when the rail vehicle travels along the pair of rails 10 in the first direction 40.

In this exemplary embodiment, the drive elements 18, 22 are each operatively connected to a combination of a one-way clutch 56 and a torsion spring 58. The combination is illustrated by way of principle in the upper part of 1 only for the drive element 22. The one-way clutch 56 is per se a known element to a person having ordinary skill in the art and serves in this embodiment to pick up and transmit a circumferential force from the drive element 22 when this performs a rotation 54 when subjected to a corresponding torque.

After a rotation in the direction of the rotation 54 of the drive element 22, the torsion spring 58 serves to reset the drive element by rotating it in the opposite direction back into a starting position. The drive element 18 is also operatively connected to a combination of a one-way clutch 56 and a torsion spring 58. With regard to picking up and transmitting a circumferential force from the drive element 18, these act in the direction of rotation 52, with regard to resetting the drive element 18 into an initial position they act opposite to the direction of rotation 52.

The middle part of the 1 shows a schematic representation of an actuating mechanism 60. The direction of view is parallel to the direction of travel of an imaginary rail switch in the place of the actuating mechanism 60. In this embodiment, the actuating mechanism comprises a control mechanism 62 and a follower device 64. The follower device 64 is operatively connected to the drive elements 18, 22 on the input side and designed to transmit the circumferential forces which can be picked up from the drive elements 18, 22.

On the output side, the follower device 64 is operatively connected with the input side of the control mechanism 62. The control mechanism 62 is itself operatively connectable to two point blades.

This results in a continuous operative connection of the drive elements 18, 22 to the point blades which allows the circumferential forces applied to the drive elements 18,22 to be transmitted as positioning forces to the point blades.

In the central part of FIG. 1, FIGS. 1*a*) to 1*d*) show states of the actuating mechanism 60, which are run through in a first operating state during a positioning operation for the movement of two point blades. In the present view, this corresponds to a movement of the control mechanism 62 to the left. FIGS. 1*a*') to 1*d*') figures show the analogous movement of the control mechanism 62 to move the point blades into a second position, in this case to the right.

The reference numerals are applicable for all FIGS. 1*a*) through 1*d*) and FIGS. 1*a*') through 1*d*') so that all the characteristics are not comprehensively marked in in each illustration.

In FIG. 1*a*), the adjusting mechanism is shown in a neutral position. The follower device 64 comprises two follower elements 66, 68. These are connected to a belt drive 70. The belt drive 70 includes four drums 72, 74, 76, 78, with a belt 80. The drum 72 is operatively connected to the drive element 18 and the drum 74 is operatively connected to the drive element 22. In this embodiment, the one-way clutch 56 assigned to the drive element 22 is connected to the drum 74. The one-way clutch assigned to the drive element 18 is connected to the drum 72. Thus the driver elements 18, 22 are designed to transmit circumferential forces onto the drums 72, 74. The follower elements 66, 68 are attached to the belt 80.

FIG. 1*b*) shows a state in which a rail vehicle is located on the drive elements 18, 22.

Through the movement of the drive elements 18, 22 in the directions of rotation 52, 54, circumferential forces are transmitted from the drive elements 18, 22 via the one way clutch 54 and another one-way-clutch onto the drums 72, 74 and from there onto the belt 80. These circumferential forces will be henceforth called positioning forces. The positioning forces make the follower elements 66, 68 move apart, in direction of the drums 72, 74. In doing so, a spring which interconnects the follower elements 66,68 is stretched. The follower elements 66, 68 are moved along the control mechanism 62.

The control mechanism 62 comprises two tilting latches 84, 86. The tilting latches 84, 86 each have a portion extending over the top side of the control mechanism 62 and a portion extending under the bottom side of the control mechanism 62.

The control mechanism is rotatably mounted about its longitudinal axis so that the top and bottom are interchangeable by rotation. FIG. 1*c*) shows the a state in which the tilting latches 84, 86 are essentially oriented from top left to bottom right. Through movement of the driver elements 66, 68 in direction of the drums 72, 74, the follower element 66 abuts the tilting latch 84. The positioning force is transmitted from the follower element 66 onto the tilting latch 84 and the control mechanism 62. As a result, the control mechanism is moved to the left. Thus, one or more operatively connectable point blades can in turn be moved to the left. The tilting latches 84, 86 are sprung. Alternatively, the follower elements 66, 68 can feature sprung elements. Thus the follower element 68 can move under and past the yielding tilting latch 86. The sprung tilting latch then moves back, thus the follower element 68 abuts the sprung tilting latch from its non-yielding side. Since both follower elements 66, 68 are fixed to the belt 80, the control mechanism 62 and any point blades operatively connectable to the control mechanism 62 are held in position via the tilting latch 86.

FIG. 1*d*) shows the control mechanism 62 rotated about its own longitudinal axis by 180 degrees. The tilting latches 84, 86 are now substantially oriented from bottom left to top right. By the rotated orientation of the control mechanism 62 the follower elements 66, 68 are released and can move towards one another, driven by the spring 82.

The previous description also applies to the FIGS. 1*a*') to 1*d*'). The rotation of the control mechanism 62 is provided, for example, by an additional actuator. As an alternative to the belt drive 70 and the tilting latches 84, 86, a similar acting system, for example a hydraulic system can be implemented. Other modes of action are possible and are selected as required by a person having ordinary skill in the art with the involvement of other technical requirements.

The lower part of 1 shows the control mechanism 62 with two indicated point blades 88, 90 and the first and second stock rail 12, 14 in a top view. The control mechanism 62 is connected via the transmission sections 92, 94 to the point blades 88, 90. Via springs 96, 98 the control mechanism 62 is held in a central, neutral position between the switch points 88, 90. In this neutral position, both point blades 88, 90 abut their respective stock rail 12, 14. This offers the advantage that due to a nonexistent gap, the point blades 88, 90 can only slightly freeze to their respective stock rail 12, 14.

If the control mechanism is moved toward the left as shown in FIGS. 1*a*)-*d*), the point blade 90 is moved to the left, away from the stock rail 14 by means of the transmission section 94. A transmission element 100 thereby gets moved into a buffer space 102 of the force transmission section 92. The spring 96 is thereby compressed. The point blade 88 remains unchanged in its position. In this considered state, by way of example, the point blades 88, 90 form a track course directing towards the right. A left turn is realized analogously. After the control mechanism 62 is rotated as shown, by way of example, between FIGS. 1*c*) and FIG. 1*d*) of FIG. 1, the control mechanism 62 can be set back to the initial position by the spring 96. The state shown, by way of example, in FIG. 1*a*), thereby is reached.

FIG. 2 shows a schematic representation of a point blade according to the invention for a rail switch in a preferred embodiment. Identical reference numerals in FIGS. 1 and 2 refer to identical features.

Any feature described in reference to a reference numeral in FIG. 1 is applicable also to the identical reference numeral of FIG. 2.

FIG. 2 shows by way of example a point blade 90 which is assigned to a rail switch, which enables a switching of a tracking path between a straight-track course and a right-turn course.

The left part of FIG. 2 shows the point blade 90 which represents, by way of example in this embodiment, a right-hand point blade of a pair of point blade pair in a top view. The point blade 90 is shown in a state in which it can be positioned against the stock rail 14, and thereby characterizes a rail switch state in which the rail switch is passable in a straight-track course. The point blade 90 features a blade tip 104. Furthermore, the point blade 90 features two sections 106, 108 in which different track courses can be formed independently of each other. These track courses can essentially correspond to a straight course, turn course or an intermediate state.

The right part of the 2 shows the detail views a, b, c. These describe a area 110 In which the sections 106, 108 merge into one in various design variants and conditions. All design variants have in common that the point blade 90 features least one portion of increased elasticity 112, 114, 116, 118, which are arranged to connect to at least two sections with a lower elasticity 106,108, 120, 122, 124, 126 is arranged. By way of example, this means that the section of increased elasticity 114 is arranged between the sections of lower elasticity 122, 124. The portion of increased elasticity 114 may for example be realized by a hard rubber sheet, while the portions with lower elasticity 122, 124 can consist of the base material of the point blade 90. A variant featuring such hard rubber inserts are, for example, shown in the detail view a.

The detailed view b shows a further variant for the production of one or more sections of increased elasticity. Detailed view b shows a sectional view through the point blade 90, wherein the rail foot 128 is partially removed, resulting in a more flexible profile of the point blade 90 in this variant. It is possible to partially or completely remove the foot of the point blade 90 in one or more areas, also it is possible, by choosing the relative stiffness of these sections to design a specific rigidity profile over the longitudinal extent of the point blade 90. The detailed view b shows an example of the case where the partial sections 106, 108 are directly connected by only one portion of increased elasticity. The area 110 is thus limited, purely by way of example in the embodiment shown in the detail view of variant b, to the area in which the foot of the point blade 90 is wholly or partially removed. In principle, the area 110 can extend from the tip of the blade 104 all the way to an intended position of a first rail fastening to the trackbed not shown here. From the first rail fastening onwards any movement of the rail is prevented. Thus, an intended mounting position of the first rail fastening, an end of the area 110 on the side opposite to the blade tip 104 and the beginning of the area 106 can advantageously coincide.

The detailed view C shows a state in which the partial section 106 has moved to form a track course corresponding to a right-hand turn in the context of the underlying rail switch, while the partial section 108 has formed a track course which corresponds to a straight-track. The area 110 taken as a whole is elastically deformed in this state. The elastic deformation is realized in the manner described in detail view A or B, or for example by a more flexible base profile of the point blade 90. Other possibilities for the production of sections with increased and reduced elasticity are known in the art. It is also possible to use relatively movable elements such as articulations.

In the present embodiment, this concerns all the variants described, the ratio between the planar moment of inertia of the point blade 90 about an x-axis (see detail view b), which here corresponds to the transverse axis and the planar moment of inertia of the point blade 90 about a y-axis (see detail view b), which here corresponds to the vertical axis, in the portion with increased elasticity 112, 114, 116, 118, preferably reaches values of up to 41. In the sub-areas with a lower elasticity 106, 108, 120, 122, 124, 126 this ratio is preferably not lower than 6.

In the area of the point blade tip 104 this ratio is preferably 41. At the end of the area 110 facing away from the tip 104, which advantageously may correspond to the position of the first rail fastening which prevents a movement of the point blade 90 and which is not shown here, the ratio is preferably 6. Starting from the point blade tip 104, the values of the ratio changes as follows: at the tip of the point blade 104, the value is more preferably at 41, and then drops along the course of the point blade following a characteristic to be determined by a person having ordinary skill in the art. The person having ordinary skill in the art determines the characteristic in particular with reference to the realizable track profiles, the resulting bending lines of the point blade 90, and the possible loads imposed by rail vehicles. Between the tip of the point blade 104 and the point of definite separation of the rail heads 38 of the point blade 90 and the associated stock rail 14, the ratio falls to a value of preferably 12. Shortly before the beginning of the section 106 or the first rail fastening the ratio falls to a value of preferably 6.

Thus, the point blade 90 exhibits along its length from its tip 104 to the beginning of the section 106 characteristic elastic properties about the y axis, while still exhibiting good stiffness about the x axis to counteract deformation about this axis.

The description for FIG. 2 can be analogously applied to other point blades, such as the point blade 88, and furthermore can be applied in the context of other rail switches and track courses, so that corresponding switch points are expressly encompassed by the present invention.

FIG. 3 shows a schematic representation of a point blade pair according to the invention in a preferred embodiment. Identical reference numerals in previous FIGS. 1 and 2 and FIG. 3 refer to identical features.

Any feature described in reference to a reference numeral in previous FIGS. 1 and 2 is also applicable to the identical reference numeral of FIG. 3.

In conformity with the embodiment shown in FIG. 2, the upper part of FIG. 3 shows by way of example a point blade pair 130 in a top view, comprising two point blades 88, 90, each with an associated stock rail 12, 14. The point blade pair 130 shown here can be attributed to a rail switch, which enables switching of a track course between a straight-track course and a right-turn course.

The lower part of 3 shows various possibilities to support and allow movement of the point blades 88, 90. By way of example, the view shown is in a traveling direction of the stock rail 12. For better illustration, a wheel of a rail vehicle 132 is shown. Variant a includes a sliding member 134 which slides over a base structure 136. The point blade 88 is connected to the sliding member 134. Thus, the point blade 88 is stabilized and the transmitted loads can be distributed across the broad base of the base structure 136. It is visible that a fastening section, in this embodiment the foot 128 of the point blade 88 facing the stock rail 12, and the foot 128 of the stock rail 12 facing the point blade 88, are both partially removed. This optional measure can avoid foreign objects getting lodged in the gap 138 between stock rail 12 and point blade 88. Variant b shows a linkage construction 140 which allows the point blade 88 to be pressed against the stock rail 12 or moved away. Variant c shows a slider 134, on the underside of which rolling elements 142 are provided. This reduces the friction and the required positioning forces. Further, such a construction can avoid any ice between the sliding member 134 and the rolling elements 142 by complete or partial encapsulation of the movable elements.

FIG. 4 shows a schematic representation of a railroad switch according to the invention in a preferred embodiment. Identical reference numerals in previous FIGS. 1-3 and FIG. 4 refer to identical features.

Any feature described in reference to a reference numeral in previous FIGS 1-3 is also applicable to the identical reference numeral of FIG. 4.

The rail switch 144 is shown in a top view. The drive element 18 is arranged on the inside of the first stock rail 12 and the drive element 22 is arranged on the inside of the second stock rail 14. The drive elements 18, 22 are arranged near the blade tips of the point blades 88, 90. A distance is chosen in a way that a rail vehicle travelling on the rail switch 144 can have a wheelset still on the drive elements 18, 22, while another part of the wheelset is already passing the tips of the point blades 88, 90. Illustrated purely by way of principle, the actuating mechanism 60, comprising the control mechanism 62, the follower device 64. The arrows between the drive elements 18, 22 and the driver device 64 and the control mechanism 62 symbolize their operative connection. The control mechanism 62 is also operatively connected to the point blades 88, 90, namely in a section lying between the blade tips and the respective area 110 of the point blades 80, 90. The area 110 is, taken as a whole, in other words, on a macroscopic level, formed in a way to deform elastically when a rail vehicle travels with one wheelset on a section near the tip, in front of the area 110, while already travelling behind the area 110 with another wheelset, while the tips of the point blades 88,90 are being re-positioned via the actuating mechanism 60.

The point blades 88, 90 then form different operative states before and after the area 110, corresponding to different track courses. At the microscopic level, the capacity of the area 110 to perform an elastic deformation is reached as described in FIG. 2. As a further possibility, several areas 110 can be provided. The design of the rail is determined for example by a wheel base, a wheel diameter, a driving speed and a mass of a railroad vehicle for which the rail switch 144 is designed. A person having ordinary skill in the art selects the exact relative arrangement of the elements of the rail switch 144 and, also selects for example, a number and/or length of sections of increased elasticity 112, 114, 116, 118 based on these parameters, and other known parameters.

FIG. 5 shows a schematic representation of a central buffer coupler for a rail vehicle according to the invention in a preferred embodiment. The upper part of FIG. 5 shows the central buffer coupler 146 in a closed state. The middle part of FIG. 5 shows the central buffer coupler 146 in an open and single-deflected state. The lower part of 5 shows the central buffer coupler 146 In an open and double-deflected state.

The central buffer coupler 146 includes a coupler arm 148. The coupler arm 148 is rotatably mounted to a partially visible rail vehicle 150 at the point P. The coupler arm 148 is shown in a top view, so it is can essentially be rotated in a horizontal plane. The central buffer coupler further comprises a coupling mechanism 152. The coupler arm 148 is is connected to a merely indicated central buffer coupler 154 of another rail vehicle via the coupler coupling mechanism 152. The central buffer coupling 146 also includes a locking mechanism 156. The locking mechanism 156 is designed to open or close the coupling mechanism 152 by retracting or advancing a drawbar 158. To open, levers 160 are provided, via which the drawbar 158 is retractable. To close, a spring 162 is provided, via which the drawbar 158 can be advanced.

The middle part of the 5 shows a deflection 160 the coupler arm 148. As a result of deflection 172 in a pivoting range 162, one of the levers 160 meets a stop 164 meets and is actuated by the stop 164. This causes the locking mechanism 156 to be operated and the coupling mechanism 152 to uncouple. In this embodiment, the coupling mechanism 152 is rotatably mounted at a point P2 to the coupler arm 148. By retracting the drawbar 158 a locking element 166 moves from a locking position 168 into an unlocking position 170.

The lower part of 5 shows that the coupling mechanism 152 is pivotable relative to the coupler arm 148 at the point P2 as a result of the locking element 166 being in the unlocking position 170. Another rail vehicle coupled to the central buffer coupler 146 via the central buffer coupler 154 can thus easily be uncoupled from the middle-buffer coupler 146, if the deflection 172 leads to one of the levers 160 meets a stop 164. This can happen, for example, in the case of a track offset between the rail vehicles 150 and 154. In the points P1 and P2 torsion springs are provided to center the entire coupler arm 148 after the deflection, to thus reach the straight position shown in the top of FIG. 5.

FIG. 6 shows a schematic representation of a central buffer coupling for a rail vehicle according to the invention in a further preferred embodiment. The upper right part of the FIG. 6 shows a central buffer coupling with a Willison-type profile 174. The lower left part of the FIG. 6 shows the central buffer coupling with Willison-type profile 174 in a side view. The lower right part of the FIG. 6 shows a view of the central buffer coupling with Willison-type profile 174 from the direction of a coupling mechanism 176, in other words, it shows the end facing away from the installation space 178 of a railroad vehicle. A coupling head 177 is blanked out. Clearly visible are the levers 160, the stops 164 are not shown in this embodiment. By actuating one of the levers a position of a latch roller 180 can be displaced. Through this displacement, a coupling rod 182 is tilted. The coupling rod 182 is provided with a lock shaft 184 connected in such a way that by tilting the coupling rod 182 the lock shaft 184 is rotatable. Rotation of the lock shaft 184 allows a rotation of the coupling mechanism 176 relative to the rest of the coupler arm 186. In the upper left part of the FIG. 6 the coupling mechanism 176 and a pivot point P3 are shown schematically. By rotation of the lock shaft 184 the coupling mechanism is also uncoupled.

7 shows a schematic representation of a rail vehicle according to the invention in a preferred embodiment. The rail vehicle 188 is a railroad car in this embodiment. This has a central buffer coupling 146, 147 in accordance with the invention at both of its ends. The rail vehicle 188 can also be a locomotive in other embodiments. The invention is applicable to both monorail vehicles and two- or multi-rail vehicles. The invention also relates generally to rail-guided vehicles, even if the concept of a rail in these contexts is an unusual term.

Figures 8A, 8B:
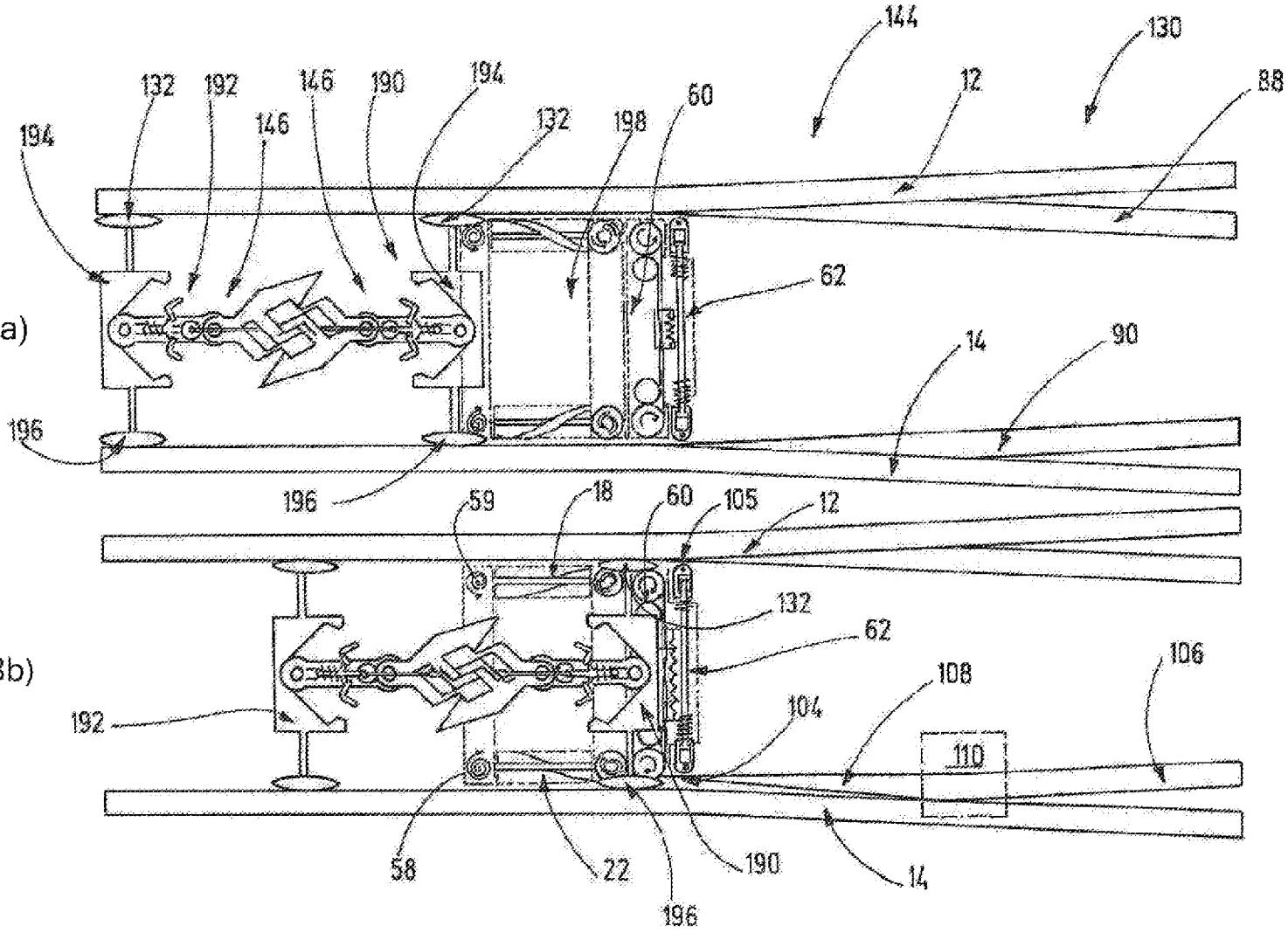

FIGS. 8*a*)-8*d*) shows a schematic representation of a rail transport system of the invention in a preferred embodiment.

Identical reference numerals in previous FIGS. 1-7 and FIGS. 8*a*)-8*d*) refer to identical features.

Any feature described in reference to a reference numeral previous FIGS. 1-7 is also applicable to the identical reference numeral of FIGS. 8*a*)-8*d*).

The partial figures in FIGS. 8*a*) through 8*d*) show identical features in different states, thus all reference numerals are not comprehensively used in each partial FIG. 8*a*) shows an only schematically indicated first rail vehicle 190 in accordance with the invention and second rail vehicle 192 in accordance with the invention. For the sake of simplicity, only one wheelset 194 with two wheel flanges 132, 196 are shown. The rail vehicles 190, 192 each comprise a central buffer coupling 146 according to the invention, which are coupled in partial FIG. 8*a*). The coupled rail vehicles 190, 192 are located directly in front of a rail switch 144 according to the invention, comprising a point blade pair 130 according to the invention with two point blades 88, 90 according to the invention and each with an associated stock rail 12, 14. The rail switch 144 further comprises a point machine 198 according to the invention. 8*a* shows a control mechanism 62 in a neutral position, as described in FIG. 1. The control mechanism 62 is set to (see also FIG. 1) transmit a deflection of the drive elements 18, 22 into an upward positioning movement of the control mechanism (this corresponds to a positioning to the left in the analogous representation in FIG. 1). The point blades 88, 90 lie against their associated stock rails 12, 14.

8*d* shows different track courses behind the rail switch 144. The first rail vehicle 190 shall, in FIG. 8*a*), follow the upwards direction shown in partial FIG. 8*d*), whereas the second rail vehicle 192 shall, in FIG. 8*a*), follow the downwards direction shown in partial FIG. 8*d*).

8*b* shows a first step of the positioning operation of the rail switch 144. In the illustrated state, the first rail vehicle 190 has, with its wheel flanges 132, 196, run over the driving elements 18, 22 thereby rotating them through about 180° in the direction of the respective stock rail 12, 14. A resulting circumferential force has (via the actuating mechanism 60 and the control mechanism 62) sectionally deflected the point blade 90 in a way to form different track courses in the sections 106, 108. This processes are, by way of example, explained in detail in FIGS. 1-4.

The first rail vehicle 190 is located, with its wheel flange 196, already partly on the tip of the blade 104, so although the first rail vehicle 190 has already passed the drive elements 18, 22, it is held in position. The distance between the drive elements 18, 22 and the point blade tips 104, 105 is chosen accordingly. The torsion springs 58, 59 of the point machine 198 try to move the drive elements 18, 22 back to the initial state shown in 8*a*, this movement is not shown in 8*b*. In preparation of a next step, the control mechanism 62 is now moved by an external actuator (see also FIG. 1), resulting in a resetting of the drive elements by the torsion springs 18, 22, so that subsequent rotating the drive elements 18, 22 entails a downward positioning movement of the control mechanism 62.

Figure 8C:
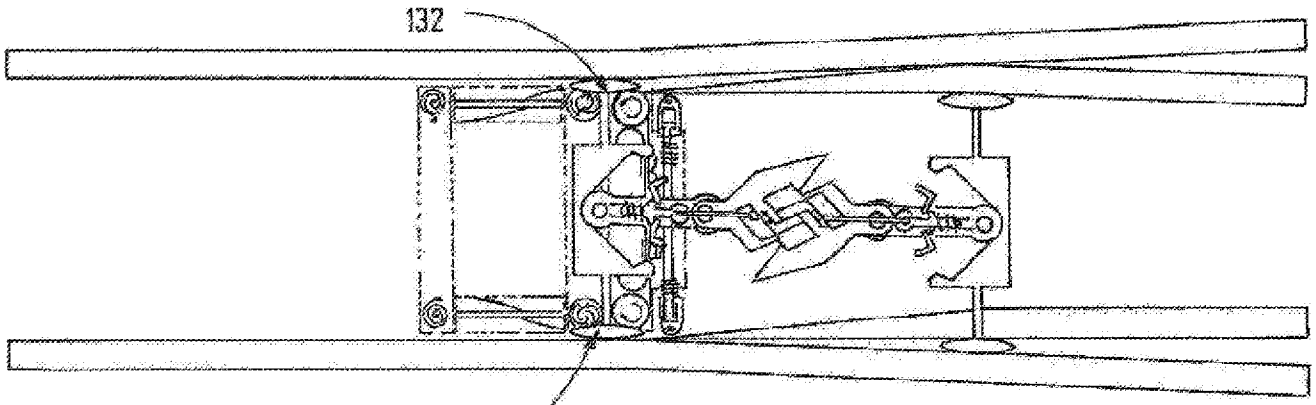
Figure 8D:
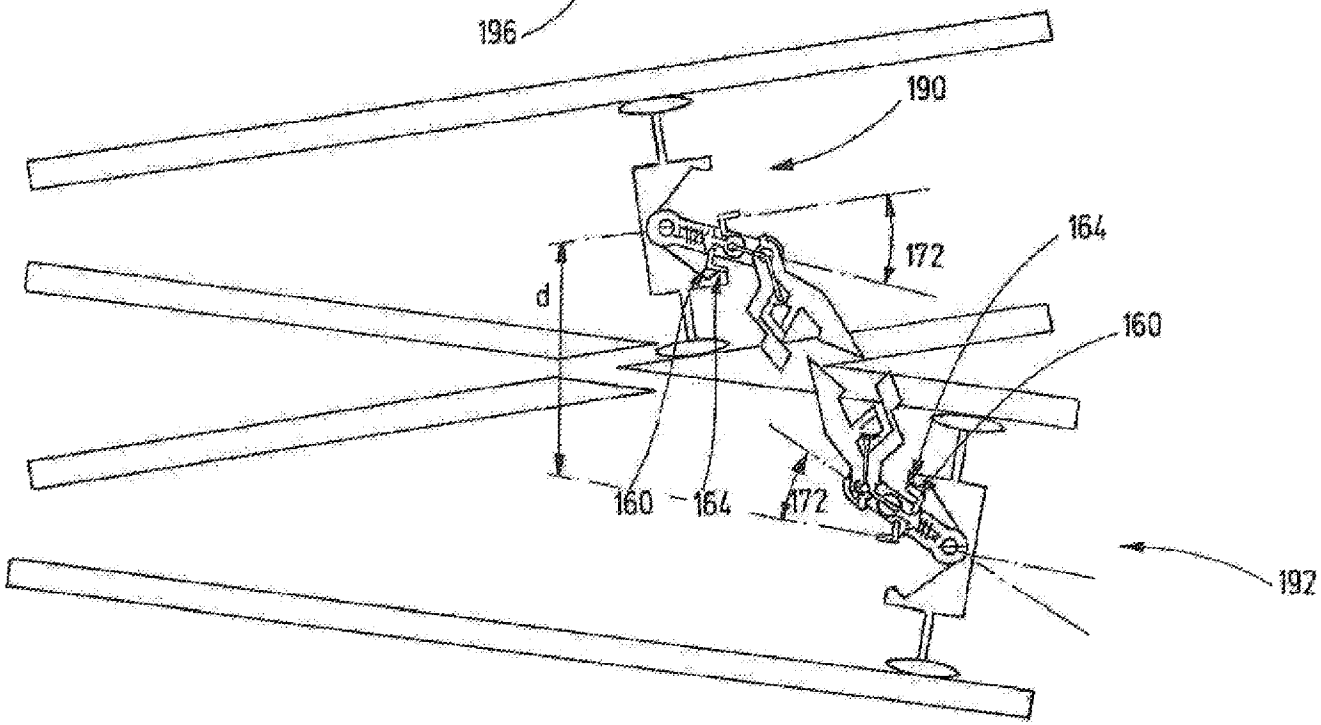

This step is shown in 8*c* as a second step of the switching operation of the rail switch 144. Analogously to the first rail vehicle in 8*b* the partial FIG. 8*c*) shows a state in which the second rail vehicle 192 has run over the drive elements 18, 22 with its wheel flanges 132, 196 and thus rotated the drive elements 18, 22. FIG. 8*c*) shows that due to the different setting of the control mechanism 62, this has entailed a downward movement of both point blades 88, 90, so in an analogous manner to the state shown in 8*b*, the point blade 88 forms sectionally different track courses. In the section near the point blade tips 104, 105, the track courses are being held in place by the wheel flanges 132, 196 of the second vehicle 192. The first vehicle 190 holds the track course in place through its wheel flanges 132, 196. The rail vehicles 190, 192 thus follow different track courses.

This procedure is shown in 8*d* in more detail. Since the rail vehicles 190, 192 increase their lateral offset by following their respective tracks while the central buffer couplers 146 are still rigidly connected, this causes at first a lateral offset d, which entails a deflection 172 of the the central buffer couplers 146. As described by way of example in FIG. 5, a sufficiently large deflection 172 leads to the lever 160 hitting its corresponding stop 164. According to the description in FIG. 5 this uncouples the central buffer couplers 146, and thereby the two rail vehicles 190, 192.

REFERENCE NUMERALS

10 pair of rails
12 first stock rail
14 second stock rail
16 Inside of the first stock rail
18 drive element
20 Inside of the second stock rail
22 drive element
24 helical structure
26 helical structure
28 outer surface
30 outer surface
32 inner surface
34 inner surface
36 rail head
38 rail head
40 first direction
42 second direction
44 inner surface
46 inner surface
48 first edge
50 first edge
52 rotational motion
54 rotational motion
56 one-way clutch
58 torsion spring
59 torsion spring
60 actuating mechanism
62 control mechanism
64 follower device
66 follower element
68 follower element
70 belt drive
72 drum
74 drum
76 drum
78 drum
80 belt
82 spring
84 tilting latch
86 tilting latch
88 point blade
90 point blade
92 transmission section
94 transmission section
96 spring
98 spring
100 transmission element
102 buffer space
104 point blade tip
105 point blade tip
106 section
108 section
110 Area
112 Section of increased elasticity
114 Section of increased elasticity
116 Section of increased elasticity
118 Section of increased elasticity
120 Section of lower elasticity
122 Section of lower elasticity
124 Section of lower elasticity
126 Section of lower elasticity
128 rail foot
130 Point blade pair
132 Wheel flange of rail vehicle
134 Sliding member
136 base structure
138 gap
140 linkage construction
142 rolling elements
144 rail switch
146 Central buffer coupling
148 coupler arm
150 rail vehicle
152 coupling mechanism
154 another rail vehicle
156 locking mechanism
158 drawbar
160 lever
162 spring

164 stop
166 locking element
168 locking position
170 unlocking position
172 deflection
174 Central buffer coupler with Willison-type profile
176 coupling mechanism
178 installation space
180 latch roller
182 coupling rod
184 lock shaft
186 rest of the coupler arm
188 rail vehicle
190 first rail vehicle
192 second rail vehicle
194 Wheelset
196 Wheel flange
198 point machine
d offset
L longitudinal direction
P1 Point
P2 Point
x transverse axis
y vertical axis

The invention claimed is:

1. A central buffer coupling for a rail vehicle, the central buffer coupling comprising:

at least one coupler arm having a deflection range and movably mountable in at least one degree of freedom to the rail vehicle;

a coupling mechanism designed to couple the at least one coupler arm to another coupler arm of another rail vehicle and mounted rotatably to the at least one coupler arm in a point; and at least one locking mechanism designed to open and close the coupling mechanism and to lock or release a pivoting movement of the at least one coupler arm in the point, wherein the locking mechanism and the rotation are released when a deflection of the at least one coupler arm relatively to the rail vehicle reaches at least one end stop and the at least one end stop is arranged within the deflection range of the at least one coupler arm.

2. The central buffer coupling for a rail vehicle according to claim 1, wherein the central buffer coupling comprises a mechanism designed to re-center the at least one coupler arm after a deflection.

3. A rail vehicle comprising at least one central buffer coupling for a rail vehicle according to claim 1.

4. A rail transport system comprising at least one rail vehicle according to claim 3.

5. The central buffer coupling for a rail vehicle according to claim 1, wherein the central buffer coupling comprises a mechanism designed to re-center the coupling mechanism after a deflection.

6. The central buffer coupling for a rail vehicle according to claim 1, wherein the end stop is arranged and configured such that the locking mechanism is automatically actuated and opened by generating a horizontal track offset between two rail vehicles coupled together via the central buffer coupling.

* * * * *